US011066293B2

(12) United States Patent
Hug

(10) Patent No.: US 11,066,293 B2
(45) Date of Patent: Jul. 20, 2021

(54) SPRING FEEDING DEVICE, APPARATUS FOR FORMING A STRING OF POCKET SPRINGS, AND METHOD OF FEEDING SPRINGS

(71) Applicant: Spuhl GmbH, Wittenbach (CH)

(72) Inventor: Christopher Hug, Grub SG (CH)

(73) Assignee: Spühl, GmbH, Wittenbach (CH)

( * ) Notice: Subject to any disclaimer, the term of this patent is extended or adjusted under 35 U.S.C. 154(b) by 452 days.

(21) Appl. No.: 16/073,056

(22) PCT Filed: Feb. 2, 2017

(86) PCT No.: PCT/EP2017/052242

§ 371 (c)(1),
(2) Date: Jul. 26, 2018

(87) PCT Pub. No.: WO2017/134159

PCT Pub. Date: Aug. 10, 2017

(65) Prior Publication Data

US 2019/0023560 A1 Jan. 24, 2019

(30) Foreign Application Priority Data

Feb. 2, 2016 (EP) ..... 16153849

(51) Int. Cl.
*B68G 9/00* (2006.01)
*B65B 63/02* (2006.01)
*B65B 9/073* (2012.01)

(52) U.S. Cl.
CPC ..... *B68G 9/00* (2013.01); *B65B 9/073* (2013.01); *B65B 63/02* (2013.01)

(58) Field of Classification Search
CPC ..... B68G 9/00; B65B 63/02; B65B 9/073; A47C 27/064
USPC ..... 53/114
See application file for complete search history.

(56) References Cited

U.S. PATENT DOCUMENTS 2,647,671 A 8/1953 McInerney
5,792,309 A 8/1998 Eto
6,698,166 B2 * 3/2004 Zysman ..... B68G 9/00 53/550

(Continued)

FOREIGN PATENT DOCUMENTS

CN 1061758 6/1992
CN 1174947 3/1998

(Continued)

OTHER PUBLICATIONS

European Patent Office; Search Report and Written Opinion in related International Patent Application No. PCT/EP2017/052242 dated Mar. 20, 2017; 10 pages.

*Primary Examiner* — Anna K Kinsaul
*Assistant Examiner* — Luis G Del Valle
(74) *Attorney, Agent, or Firm* — Wood Herron & Evans LLP

(57) ABSTRACT

A spring feeding device configured to feed a spring (9) comprises a feeding member (60) delimiting a channel (68), a pusher (70) configured to push the spring (9) along the channel (68) delimited by the feeding member (60), and a drive mechanism con-figured to displace both the feeding member (60) and the pusher (70) such that the feeding member (60) and the pusher (70) move in opposite directions (91, 92).

11 Claims, 8 Drawing Sheets

(56) References Cited

U.S. PATENT DOCUMENTS

| | | | | |
|---|---|---|---|---|
| 2013/0247518 | A1* | 9/2013 | Spinks | B68G 9/00<br>53/438 |

FOREIGN PATENT DOCUMENTS

| | | | |
|---|---|---|---|
| CN | 2687096 | | 3/2005 |
| CN | 2748386 | | 12/2005 |
| CN | 203976392 | U | 12/2014 |
| JP | S6135000 | A | 2/1986 |
| WO | 2007031774 | A1 | 3/2007 |

* cited by examiner

SPRING FEEDING DEVICE, APPARATUS FOR FORMING A STRING OF POCKET SPRINGS, AND METHOD OF FEEDING SPRINGS

TECHNICAL FIELD

Embodiments of the invention relate to devices and methods for feeding a spring in a pocketing device in which the spring is enclosed in a pocket of fabric. Embodiments of the invention relate in particular to devices and methods for feeding a spring in a pocketing device for producing strings of pocket springs for seating or lying furniture. Embodiments of the invention may be used to produce a string of pocket springs in which each spring is enclosed by an associated pocket of fabric.

BACKGROUND

Mattresses, sofas or other bedding or seating furniture may be provided with innerspring units. Innerspring units may be formed by unpocketed springs or as pocket spring units. Innerspring units that use pocket springs in which a spring is enclosed in an associated pocket of fabric are generally considered to offer enhanced comfort compared to many conventionally sprung mattresses or other bedding or seating furniture using springs connected by a wire framework. This is partly because pocketed springs may better conform to the shape of a person's body than a mesh of interconnected springs in which the deformation of one spring may more strongly affect the adjacent springs. In addition, the presence of the fabric pocket between adjacent springs lessens the likelihood that the springs will rub against each other, thereby reducing noise.

Techniques of producing an innerspring unit from pocketed springs typically require a spring to be inserted into a tube of pocket material. A spring feeding device may feed the spring towards the tube of pocket or within the tube of pocket. Such a spring feeding device may include a displaceable pusher that advances the spring through a channel. Conventional spring feeding devices of this kind require the pusher to be displaced by a distance that corresponds to the overall feed length of the spring. Cycle times for such spring feeding devices may be undesirably long, which may affect the overall performance of an apparatus for forming a string of pocket springs in which the spring feeding device is installed.

SUMMARY

There is a continued need in the art for devices and methods of feeding springs that mitigate at least some of the above drawbacks. There is a continued need in the art for devices and methods of feeding springs that reduce cycle times and/or construction space requirements compared to devices in which a pusher advances the spring through a stationary channel.

According to embodiments of the invention, a device and method of feeding a spring into or within a tube of pocket material are provided. One or several feeding members delimit a channel in which the spring is advanced. Both the feeding member(s) and the pusher which extends in the channel delimited by the feeding member(s) are concurrently displaced in opposite directions. The combined movement of the pusher and the feeding member(s) delimiting the channel reduces the travel path of the pusher by a factor of two compared to a device having a stationary channel, thereby reducing the cycle time.

A spring feeding device according to an embodiment is configured to feed a spring for pocketing the spring, e.g. by feeding the spring towards or within a tube of fabric from which the pocket is formed. The spring feeding device comprises a feeding member delimiting a channel. The spring feeding device comprises a pusher configured to push the spring along the channel delimited by the feeding member. The spring feeding device comprises a drive mechanism configured to displace both the feeding member and the pusher such that the feeding member and the pusher move in opposite directions.

The combined movement of the pusher and of one or several feeding member(s) that define the channel in which the spring is advanced provides improvements in terms of cycle time and/or construction space.

The drive mechanism may be configured to displace the feeding member in a first direction and to displace the pusher in a second direction opposite to the first direction during a first phase of an operating cycle. The drive mechanism may be configured to displace the feeding member in the second direction and to displace the pusher in the first direction during a second phase of the operating cycle. An efficient operation with short cycle times may be attained thereby.

The drive mechanism may be configured to concurrently displace the feeding member and the pusher in a translatory manner. The spring feeding device may comprise a first guide for the feeding member and a second guide for the pusher. The first guide may support the feeding member for translatory displacement. The second guide may support the pusher for translatory displacement.

The drive mechanism may comprise a drive belt to which both the feeding member and the pusher are coupled. A simple construction of the drive mechanism that concurrently displaces the feeding member and the pusher in opposite directions may be attained thereby.

The drive mechanism may comprise a power drive configured to alternatingly drive the drive belt in opposite directions.

The spring feeding device may comprise a control device configured to control the drive mechanism and the pocketing mechanism in a coordinated manner. The control device may be configured to control the displacement of the pusher, the feeding member, and of an ultrasonic welding unit in a coordinated manner.

The spring feeding device may be configured to receive the spring in a compressed state from a spring setting device.

The channel delimited by the feeding member may be dimensioned to retain the spring in a compressed state in a force fit. The channel may have a width which is less than a height of the spring measured along a spring axis of the spring when the spring is in an uncompressed state. Alternative or additional retention mechanisms may be used. For illustration. at least one magnet may be provided to retain the spring in a compressed state in the channel.

The spring feeding device may comprise a first feeding member and a second feeding member which are offset from each other and extend parallel to each other. Both the first feeding member and the second feeding member may be coupled to the drive mechanism so as to move jointly. The first feeding member, the second feeding member, and the pusher may be coupled to a drive belt such that both the first feeding member and the second feeding member move in a direction opposite to a movement direction of the pusher whenever the pusher is displaced.

The feeding member may have a tapering shape. An end portion may retain the spring when the spring is retrieved by an ultrasonic welding unit from the spring feeding device. The end portion may have a length that extends across a diameter of an end ring of the spring. The end portion may have a width which is smaller than a diameter of an end ring of the spring. The end portion of the feeding member may be dimensioned such that the spring retained thereon projects from the end portion in a radial direction of the spring, thereby facilitating retrieval of the spring by the ultrasonic welding unit.

The feeding member may be displaceably supported such that at least the end portion from which the spring is retrieved by an ultrasonic welding unit remains positioned in a tube of fabric for any position of the feeding member.

An apparatus for forming a string of pocket springs according to an embodiment comprises the spring feeding device according to an embodiment and a pocketing mechanism configured to receive the spring from the spring feeding device and to enclose the spring in a pocket of fabric.

The pocketing mechanism may comprise a bracket to which an ultrasonic sonotrode and/or an anvil are displaceably mounted. The bracket may be pivotably mounted. Such a configuration allows the ultrasonic welding unit that forms a transverse seam of a pocket to pick up the spring from the feeding member of the spring feeding device. Compact construction of the apparatus may be attained thereby.

The bracket may comprise a guide structure to guide displacement of the ultrasonic sonotrode and/or of the anvil relative to the bracket. A pivot axis of the bracket may extends transverse to a longitudinal axis of the guide structure.

The feeding member may have an end portion which is dimensioned such that the spring projects from the end portion while the spring is retained by the end portion. The ultrasonic sonotrode and/or the anvil may be configured to be passed over the spring projecting from the end portion of the feeding member when the feeding member is at a discharge position. The ultrasonic welding unit may thereby retrieve the spring from the spring feeding device.

A method of feeding a spring to a pocketing mechanism according to an embodiment comprises receiving the spring in a channel delimited by a feeding member. The method comprises displacing a pusher and the feeding member in opposite directions such that the pusher displaces the spring along the channel. The method comprises reversing a movement direction of the pusher and a movement direction of the feeding member to return the pusher to an initial position.

Effects attained by the method and further features that may be implemented in the method correspond to the features described with reference to the spring feeding device are the apparatus according to embodiments.

The method may be performed by the spring feeding device or by the apparatus according to an embodiment.

According to another aspect of the invention, there is provided an apparatus for forming a string of pocket springs that comprises an ultrasonic welding unit. The ultrasonic welding unit comprises a sonotrode and an anvil. At least one of the sonotrode or the anvil is mounted to a bracket which is pivotably mounted.

Such a pivotable ultrasonic welding unit may be used independently of the spring feeding device in which both the pusher and the feeding member are displaced concurrently and in opposite directions. However, as will be described more detail below, the pivoting bracket with the sonotrode and the anvil mounted on may advantageously be combined with the spring feeding device in which both the pusher and the feeding member are displaced concurrently and in opposite directions.

The bracket may be pivoted under the control of a control device to retrieve a spring from the spring feeding device.

A spring feeding device, an apparatus, and a method according to embodiments may be used to produce a string of pocket springs for mattresses or other furniture, without being limited thereto. A spring feeding device, an apparatus, and a method according to embodiments reduce cycle times and construction space by reducing the travel path length of the pusher.

BRIEF DESCRIPTION OF THE DRAWINGS

Embodiments of the invention will be described in detail with reference to the drawings in which like reference numerals designate like elements.

DESCRIPTION OF EMBODIMENTS

Figure 1:
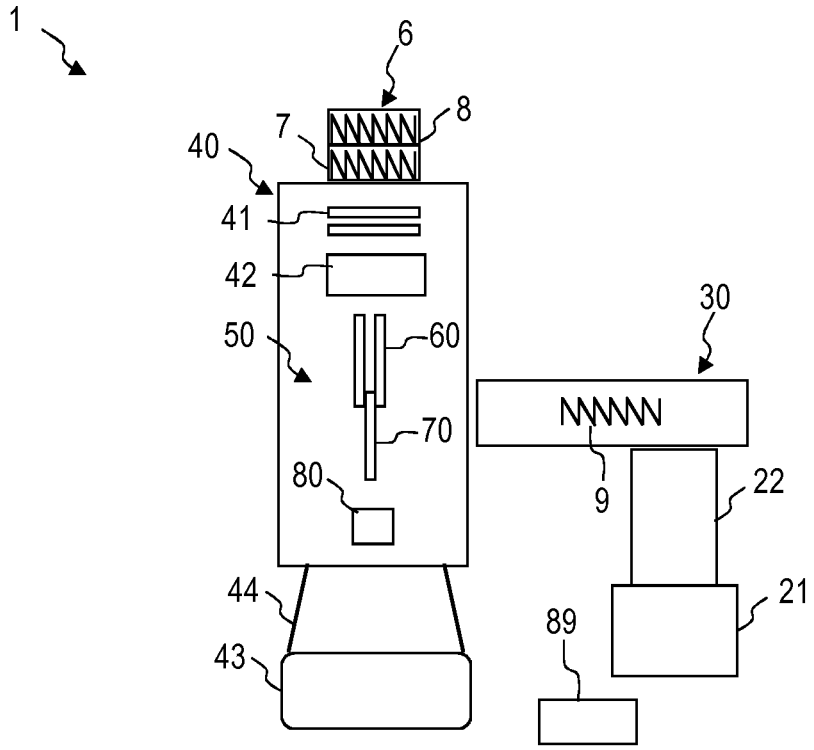
FIG. 1 shows a schematic view of an apparatus according to an embodiment.

Embodiments of the invention will be described with reference to the drawings in which like reference numerals designate like elements.

While embodiments of the invention will be described in the context of specific applications of a spring feeding device, it will be appreciated that the embodiments are not limited thereto. For illustration, while some embodiments will be described in the context of a spring feeding device which is integrated in an apparatus which also includes a spring former and/or a spring setting device, the configuration of the spring feeding device according to embodiments is not limited thereto.

FIG. 1 illustrates an apparatus 1 for forming a string 6 of pocket springs 7, 8 according to an embodiment.

The apparatus 1 may comprise a spring former 21 which winds springs and a cooling channel 22 in which the wound springs are allowed to cool down. The cooling channel 22 may comprise a plurality of receptacles, each configured to receive a spring.

The apparatus 1 comprises a spring setting device 30. The spring setting device 30 is operative to set a spring, i.e., to compress the spring for the first time after it has been wound.

The apparatus 1 comprises a pocketing device 40 for pocketing a spring. The pocketing device 40 is configured to enclose the spring in an associated pocket of fabric. Fabric may be supplied to the pocketing device 40 from a supply 43, which may be a roll of fabric. The fabric may be a non-woven fabric. The fabric may be folded to form a tube 44 of pocket material in which the spring 9 is inserted. The pocketing device 40 may comprise a fabric folding unit 42 which may comprise one or several abutment surfaces, e.g. in the form of a cassette, around which the fabric is folded to form the tube of pocket material into which the springs are inserted.

The pocketing device 40 may comprise at least one unit for forming a seam on the tube of folded fabric. The pocketing device 40 may comprise a first ultrasonic welding unit for forming a longitudinal welded seam extending along a longitudinal axis of the folded fabric. The pocketing device 40 may comprise a second ultrasonic welding unit 41 for forming transverse seams which extend between the pockets of the string 6.

The pocketing device 40 comprises a spring feeding device 50 according to an embodiment. As will be described in detail with reference to FIG. 2 to FIG. 20, the spring feeding device 50 comprises one or several feeding members 60. The one or several feeding members 60 define a channel through which the spring may be fed towards the ultrasonic welding unit 41 and into the tube of pocket material. The spring feeding device 50 comprises a pusher 70. As will be described in more detail below, both the pusher 70 and the one or several feeding members 60 are a displaceable, for example in a translatory manner. The spring feeding device 50 comprises a drive mechanism 80. The drive mechanism 80 may be configured to concurrently displace the feeding member(s) 60 and the pusher 70 in a reciprocating manner in opposite directions.

A control device 89 may control operation of the spring feeding device 50 and of the ultrasonic welding unit 41. The control device 89 may be configured to control operation of other units of the apparatus one, such as operation of the spring former 21, of the cooling channel 22, or of the setting station 30.

A spring feeding device 50 according to an embodiment will be described in more detail with reference to FIG. 2 to FIG. 20.

Figure 2:
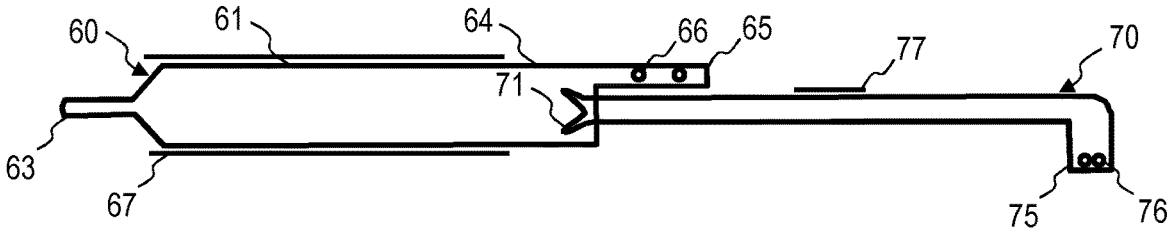
FIG. 2 shows a schematic side view of a spring feeding device according to an embodiment.
Figure 3:
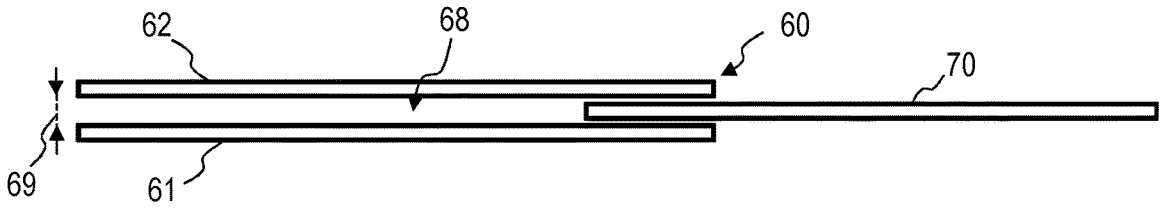
FIG. 3 shows a top view of the spring feeding device of FIG. 2.

FIG. 2 shows a side view of a spring feeding device 50 according to an embodiment. FIG. 3 shows a top view of the spring feeding device 50. The spring feeding device 50 may be installed in the apparatus 1 of FIG. 1 to feed springs towards or within a tube of pocket material.

The spring feeding device comprises at least one feeding member 60 which delimits a channel 68 configured to receive a spring. The channel 68 may be dimensioned such that it has a width 69 configured to retain the spring in a force fit. The width 69 may be smaller than a height of the spring that is fit when the spring is in a rest state.

The spring feeding device may comprise a first feeding member 61 and a second feeding member 62 which extend parallel to each other and are spaced by a distance 69.

The channel 68 may extend between the first feeding members 61 and the second feeding member 62. The first feeding members 61 and the second feeding member 62 may have mirror-symmetric configurations. Features that will be explained for the feeding member 61 below may similarly be implemented on the second feeding members 62. One integral feeding member or still other configurations may be used to define the channel 68.

At least an inlet portion 64 of the channel 68 is arranged such that a spring is insertable into the channel 68. For illustration, the gap between the first feeding member 61 and the second feeding member 62 may be open on an upper end side to allow a spring to be inserted.

The at least one feeding member 60 may be configured to receive a set spring in the channel 68. The inlet portion 64 may be arranged to receive the set spring from the spring setting device 30. The at least one feeding member 60 may have an end portion 63. The end portion 63 may define an end of the at least one feeding member 60 and may be formed at a tapering section of the at least one feeding member 60. The end portion 63 may be dimensioned such that the end portion 63 can extend across a diameter of the spring retained thereon. The end portion 63 may have a length that is equal to or greater than a diameter of an end ring of the spring that is fed to the ultrasonic welding unit. The end portion 63 may have a width which is smaller than a diameter of an end ring of the spring. As will be explained in more detail below, such a configuration facilitates retrieval of a spring by the ultrasonic welding unit from the spring feeding device 50.

The feeding member(s) 61, 62 is displaceably supported. As will be described in more detail, the feeding member 61, 62 is displaced in a reciprocating manner during operation of the spring feeding device 50. The feeding member 61, 62 may be slidably supported on a guide 67. The guide 67 may define a recess or another guide structure that supports the feeding member 61, 62 for translatory displacement.

The feeding member(s) 61, 62 is coupled to a drive mechanism. The feeding member 61, 62 may have an attachment portion 65 for attachment to a drive belt, lever, or other output of a drive mechanism. Mounts 66 which may be screws, bolts, or other mounts may attach the feeding member 61, 62 to the drive mechanism.

The feeding member 61, 62 may be mounted such that at least the end portion 63 is positioned within a tube of fabric that is used to form the pockets for the springs for at least one position of the feeding member 61, 62. The feeding member 61, 62 may be displaceably mounted such that the end portion 63 remains located within the tube of fabric for any position of the feeding member 61, 62.

The spring feeding device 50 comprises a pusher 70. The pusher 70 is configured to push a spring received in the channel 68 along the channel 68. The pusher 70 may have an engagement portion 71 to engage the spring received in the channel 68. The pusher 70 is dimensioned and supported to push the spring received in the channel 68 at a position below the inlet portion 64 along the length of the channel 68 to the end portion 63. The pusher 70 may be dimensioned and supported such that the engagement portion 71 extends into the channel 68 at any position of the pusher 70 relative to the at least one feeding member 60.

The pusher 70 is displaceably supported. The spring feeding device comprises a guide 77 to guide displacement of the pusher 70. The guide 77 may guide the pusher 70 translatory displacement. The guide 67 for the at least one feeding member 60 and the guide 77 for the pusher 70 may be integrally formed. The guide 67 for the at least one feeding member 60 and the guide 77 for the pusher 70 may be configured so as to ensure that the pusher 70 and the at least one feeding member 60 are forced to move parallel to each other.

The pusher 70 has an attachment portion 75 for coupling the pusher 70 the drive mechanism. The attachment portion 75 may be attached to a drive belt, lever, or other output of the drive mechanism. Mounts 76 which may be screws, bolts, or other mounts may attach the pusher 70 to the drive mechanism. The pusher 70 and the at least one feeding members 61, 62 may be attached to the same drive belt, leather, or other output of the drive mechanism.

Operation of the spring feeding device 50 of FIG. 2 and FIG. 3 will be described in more detail with reference to FIG. 4 to FIG. 20 below. Generally, the drive mechanism 80 of the spring feeding device 50 is configured to displace both the at least one feeding member 60 and the pusher 70 in such a manner that the at least one feeding member 60 and the pusher 70 are displaced in opposite directions. The drive mechanism 80 may be configured to displace both the at least one feeding member 60 and the pusher 70 in such a manner that the at least one feeding member 60 and the pusher 70 are concurrently displaced in a translatory manner, with the motion vector of the feeding member 61, 62 and the motion vector of the pusher 70 pointing in opposite directions at any time during the operating cycle.

Referring to FIG. 4 to FIG. 13, different faces of an operating cycle of the spring feeding device will be explained in detail.

Figure 4:
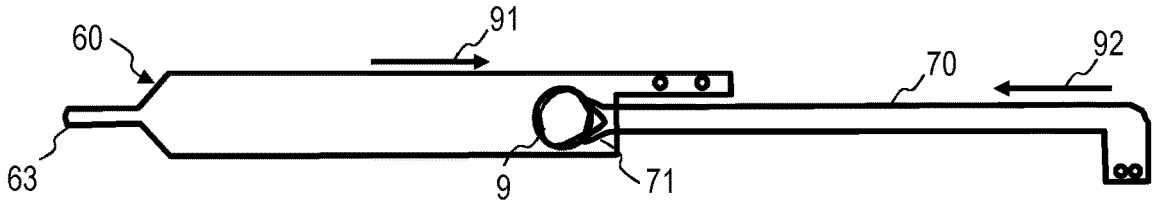
FIG. 4 shows a schematic side view of the spring feeding device of FIG. 2 during a first phase of an operating cycle.
Figure 5:
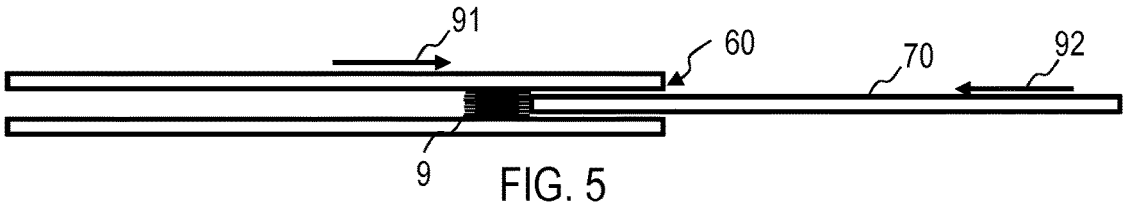
FIG. 5 shows a schematic top view of the spring feeding device of FIG. 2 during the first phase of the operating cycle.

FIG. 4 shows a side view of the spring feeding device during a first phase of an operating cycle. FIG. 5 shows a top view of the spring feeding device during the first phase of the operating cycle. At the beginning of the first phase of the spring 9 is received in the channel 68. The spring 9 may be inserted into the channel 68 in a direction that is generally transverse and may be perpendicular to the motion direction of the at least one feeding members 61, 62 and of the pusher 70.

In the first phase of the operating cycle, the at least one feeding member 60 is displaced in a first direction 91. The pusher 70 is displaced in a second direction 92. The second direction 92 is opposite to the first direction 91. Both the at least one feeding member 60 and the pusher 70 may be displaced such that at any time during the first phase a velocity of the at least one feeding member 60 and a velocity of the pusher 70 have equal magnitude but opposite directions. In other embodiments, the at least one feeding member 60 and the pusher 70 may be displaced such that the velocity of the at least one feeding member 60 and the velocity of the pusher 70 have opposite directions, while the magnitudes may be different from each other.

As illustrated in the top view of FIG. 5, the spring 9 may be received in the channel delimited by the at least one feeding member 60 such that the spring 9 is retained by the at least one feeding member 60 in a force fit. The engagement portion 71 may engage the spring 9 at at least a portion or all of its axial length to advance the spring 9 along the length of the channel to the end portion 63.

Figure 6:
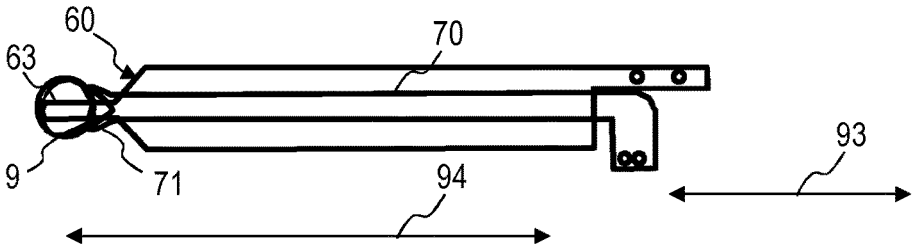
FIG. 6 shows a schematic side view of the spring feeding device of FIG. 2 at the end of the first phase of the operating cycle.
Figure 7:
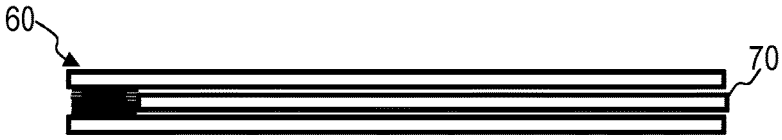
FIG. 7 shows a schematic top view of the spring feeding device of FIG. 2 at the end of the first phase of the operating cycle.

FIG. 6 shows a side view of the spring feeding device at the end of the first phase of the operating cycle. FIG. 7 shows a top view of the spring feeding device at the end of the first phase of the operating cycle.

At the end of the first phase of the operating cycle, the pusher 70 has advanced the spring 9 to the end portion 63. The spring 9 may be retained between the end portion 63 of the first feeding member 61 and the end portion of the second feeding member 62. As best seen in FIG. 6, the end portion 63 has a length which extends across the diameter of the spring 9. The end portion 63 may have a width which is less than the diameter of an end ring of the spring 9. Such a configuration facilitates retrieval of the spring 9 from the spring feeding device 50 by an ultrasonic welding unit, for example, once the at least one feeding member 60 was displaced to a discharge position at which the ultrasonic welding unit retrieves the spring 9.

Because both the pusher 70 and the at least one feeding member 60 are concurrently displaced in opposite direction in the first operational phase of the operating cycle, the spring 9 may be displaced relative to the at least one feeding member 60 by a distance 94 which corresponds to the distance between the end portion 63 and the inlet portion 64 along the length of the channel 68. The pusher 70 must be displaced by a distance 93 which is only half of the distance 94 by which the spring 9 is displaced relative to the at least one feeding member 60 in the channel 68. Because the pusher 70 may return to its initial position while the at least one feeding member 60 continuous to advance the spring towards an ultrasonic welding unit, the cycle time is reduced compared to alternative configurations in which the channel 68 is stationary while only the pusher 70 is displaced.

Figure 8:
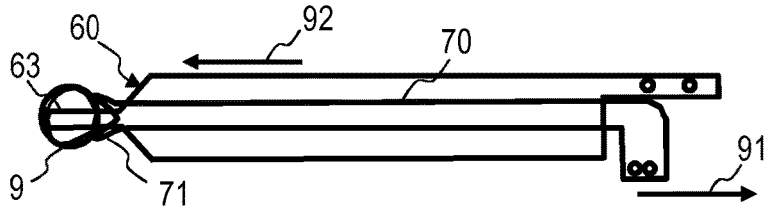
FIG. 8 shows a schematic side view of the spring feeding device of FIG. 2 during a second phase of the operating cycle.
Figure 9:
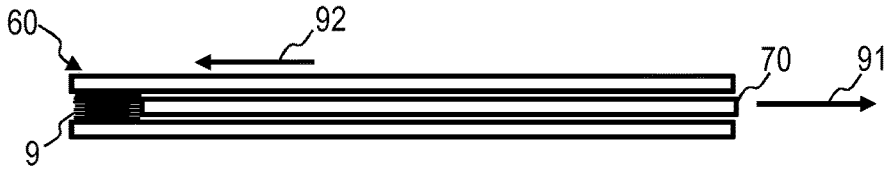
FIG. 9 shows a schematic top view of the spring feeding device of FIG. 2 during the second phase of the operating cycle.

FIG. 8 shows a side view of the spring feeding device during a second phase of the operating cycle. FIG. 9 shows a top view of the spring feeding device during the second phase of the operating cycle.

In the second phase of the operating cycle, the at least one feeding member 60 continuous to displace the spring 9 towards the ultrasonic welding unit. The pusher 70 is concurrently returned to its initial position that allows a further spring to be inserted into the channel 68. Similarly, the at least one feeding member 60 is concurrently returned to its initial position that allows the further spring to be inserted into the channel 68.

In the second phase of the operating cycle, the pusher 70 is at least partially withdrawn from the channel 68 delimited by the at least one feeding member 60.

As illustrated in FIG. 8 and FIG. 9, during the second phase of the operating cycle the at least one the feeding member 60 is displaced in the second direction 92 and the pusher 70 is displaced in the first direction 91. Both the direction of motion of the at least one feeding members 60 that delimits the channel 68 and the direction of motion of the pusher 70 is reversed compared to the preceding first phase of the operating cycle.

Figure 10:
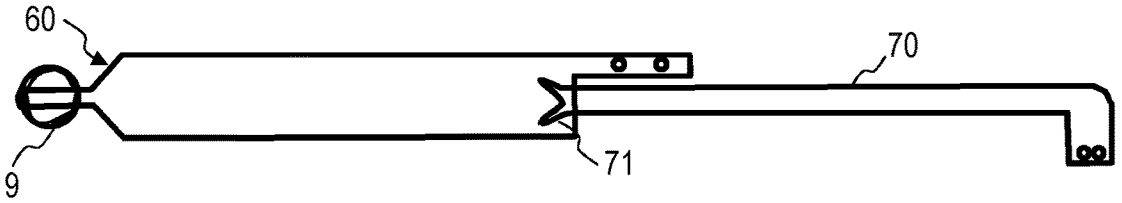
FIG. 10 shows a schematic side view of the spring feeding device of FIG. 2 at the end of the second phase of the operating cycle.
Figure 11:
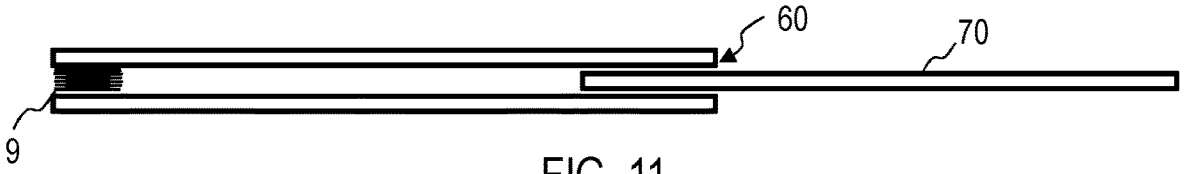
FIG. 11 shows a schematic top view of the spring feeding device of FIG. 2 at the end of the second phase of the operating cycle.

FIG. 10 shows a side view of the spring feeding device at the end of the second phase of the operating cycle. FIG. 11 shows a top view of the spring feeding device at the end of the second phase of the operating cycle.

At the end of the second phase of the operating cycle, the pusher 70 has been withdrawn from the channel 68 to an extent which allows a further spring to be inserted into the channel 68.

At the end of the second phase of the operating cycle, the at least one feeding member 60 has been displaced to a discharge position which corresponds to the initial position of an operating cycle. At the discharge position, the at least one feeding member 60 is positioned such that the spring 9 retained on the end portion 63 may be retrieved by an ultrasonic welding unit, for example. As described above, the end portion 63 has a length which extends across the diameter of an end ring of the spring 9. The end portion 63 may have a width which is less than the diameter of an end ring of the spring 9. Such a configuration facilitates retrieval of the spring 9 from the spring feeding device 50 by an ultrasonic welding unit, for example.

Figure 12:
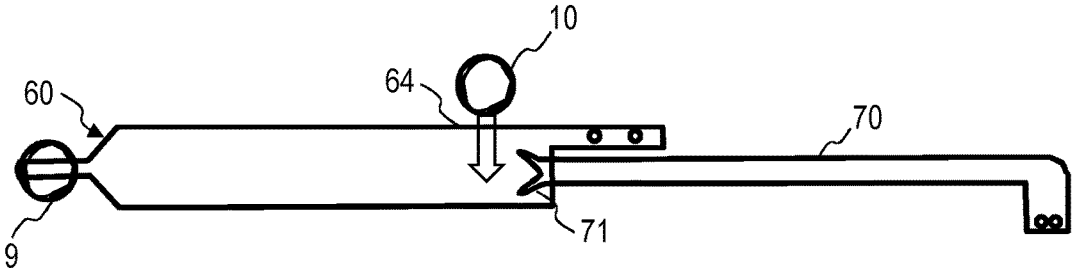
FIG. 12 shows a schematic side view of the spring feeding device of FIG. 2 during a third phase of the operating cycle.
Figure 13:
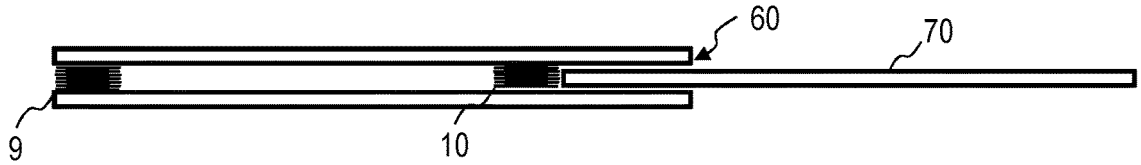
FIG. 13 shows a schematic top view of the spring feeding device of FIG. 2 during the third phase of the operating cycle.

FIG. 12 shows a side view of the spring feeding device during a third phase of the operating cycle. FIG. 13 shows a top view of the spring feeding device during the third phase of the operating cycle.

In the third phase of the operating cycle, a further spring 10 may be inserted into the channel 68. The at least one feeding member 60 and the pusher 70 may remain stationary while the further spring 10 and test into the channel 68 and is captured by the sidewalls of the channel 68 in a form fit. The previously fed spring 9 may be removed from the end portion 63 after the further spring 10 has been inserted into the channel 68.

In the spring feeding device 50 according to any one of the embodiments described herein, the at least one feeding member 60 and the pusher 70 may be attached to the same output member of the drive mechanism. For illustration, the at least one feeding member 60 and the pusher 70 may be attached to one and the same drive belt, one and the same lever, or another drive mechanism output member.

Figure 14:
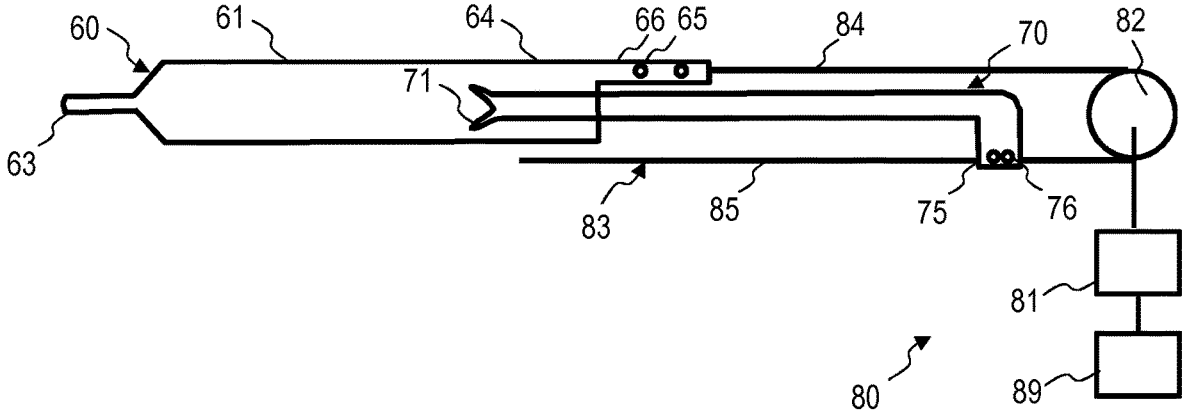
FIG. 14 shows a schematic side view of the spring feeding device of FIG. 2.

FIG. 14 shows a spring feeding device 50 according to an embodiment including a drive mechanism 80.

The drive mechanism 80 may comprise a drive belt 83. The drive belt 83 may be an endless belt. The drive belt 83 may have a first section 84 and a second section 85. The first section 84 and the second section 85 may extend parallel to each other. The first section 84 and the second section 85 may be spaced from each other in a direction that is transverse to a motion direction of the at least one feeding member 60 and the pusher 70.

The at least one feeding member 60 may be attached to the first section 84 of the drive belt 83. The pusher 70 may be attached to the second section 85 of the drive belt 83. Motion of the drive belt 83 causes the at least one feeding member 60 and the pusher 70 to be concurrently displaced in opposite directions, with the velocities having equal the same magnitude.

The drive mechanism 80 may comprise a power drive 81, which may be an electric motor one. The power drive 81 may rotate a drive gear 82 that is engaged with the drive belt 83. The power drive 81 may be controlled by a control device 89. The power drive 81 may be configured to rotate the drive gear 82 in opposite directions of rotations in an alternating manner. The power drive 81 may be configured to rotate the drive gear 82 in a first direction of rotation during the first phase of the operating cycle, and to rotate the drive gear 82 in a second direction of rotation that is opposite to the first direction of rotation during the second phase of the operating cycle.

The control device 89 may be operatively coupled with other units of the apparatus 1 illustrated in FIG. 1. The control device 89 may be configured to control operation of the drive mechanism 80 of the spring feeding device 50 and operation of an ultrasonic welding unit in a coordinated manner. The control device 89 may alternatively or additionally be configured to control operation of the spring setting device 30 and of the drive mechanism 80 of the spring feeding device 50 in a coordinated manner.

The pocketing device 40 which pockets the spring fed by the spring feeding device 50 may comprise an ultrasonic welding unit. The ultrasonic welding unit may be configured to retrieve the spring held by the end portion 63 of the at least one feeding member 60 in order to form a transverse seam of a pocket in which the spring is enclosed.

Figure 15:
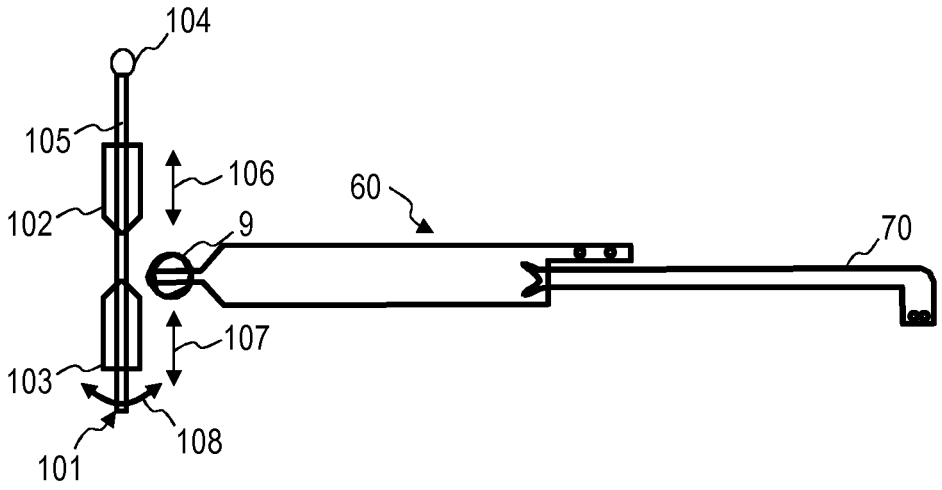
FIG. 15 shows a schematic side view of the spring feeding device and of a pivotable ultrasonic welding unit for forming transverse seams according to an embodiment.
Figure 16:
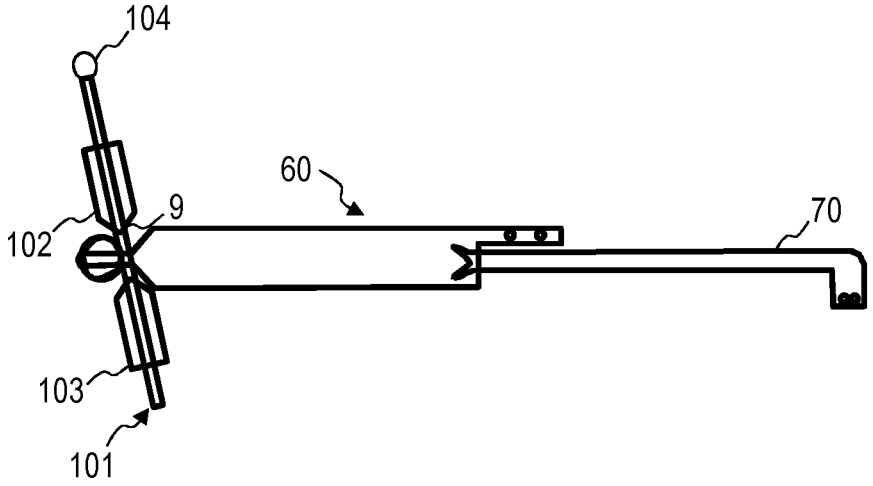
FIG. 16 shows a schematic side view of the spring feeding device and of the pivotable ultrasonic welding unit of FIG. 15 at retrieval of the spring from the spring feeding device.

FIG. 15 and FIG. 16 show in ultrasonic welding unit that may be used in the apparatus one. While the ultrasonic welding unit explained with reference to FIG. 15 and FIG. 16 may be used in conjunction with a spring feeding device 50 according to an embodiment, the ultrasonic welding unit may also be used in association with a conventional spring feeding device which has a stationary channel through which the spring is advanced by a pusher.

The ultrasonic welding unit comprises a bracket 101. A sonotrode 102 and/or an anvil 103 may be supported on the bracket 101. The sonotrode 102 may be supported on the bracket 101 so as to be linearly displaceable along the bracket 101. The bracket 101 may define a guide 105 that defines the motion path for linear displacement 106 of the sonotrode 102 on the bracket 101. The anvil 103 may be supported on the bracket 101 so as to be linearly displaceable along the bracket 101. The bracket 101 may define a guide that defines the motion path for linear displacement 107 of the anvil 103 on the bracket 101.

The bracket 101 may be mounted such that it is pivotable. The bracket 101 may have a pivot axis 104 about which it is pivotable. The bracket 101 may be pivotably mounted. A pivoting motion 108 of the bracket 101 may be controlled by the control device 89.

An actuator for pivoting the bracket 101 may be operated under the control of the control device 89 in a manner which is coordinated with the movement of the at least one feeding member 60 and of the pusher 70 of the spring feeding device 50.

As best seen in FIG. 16, the bracket 101 may be controlled to prevent such that the ultrasonic welding unit retrieves a spring retained the end portion 63 of the at least one feeding member 60. A return pivoting motion of the bracket 101 may be performed before or while the sonotrode 102 and the anvil 103 are displaced towards each other for forming a transverse seam between pockets.

In any one of the various embodiments described herein, the spring feeding device 50 may be disposed such that at least a portion of the spring feeding device 50 extends within a part of a fabric tube 44 that is formed by the apparatus 1. This will be explained in more detail with reference to FIG. 17 and FIG. 18.

Figure 17:
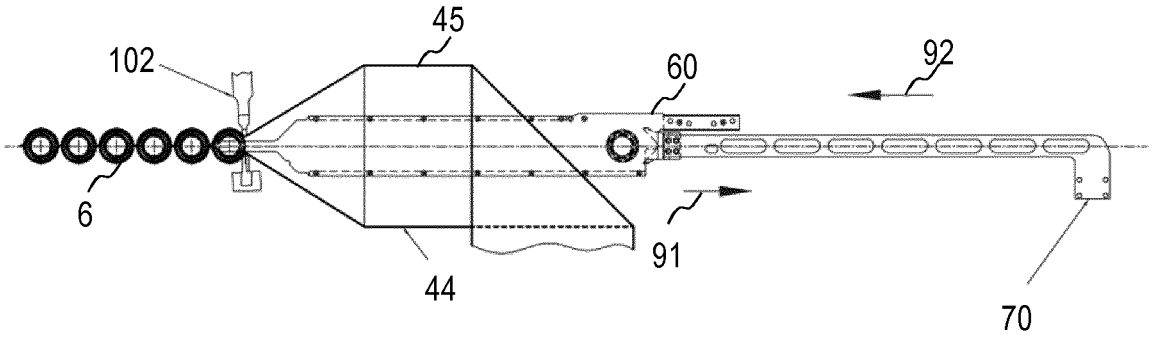
FIG. 17 shows a schematic side view of a spring feeding device according to an embodiment.
Figure 18:
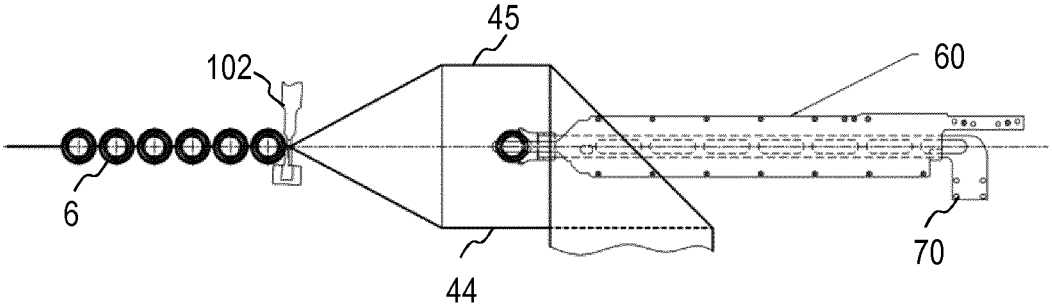
FIG. 18 shows a schematic side view of a spring feeding device according to an embodiment.

FIG. 17 and FIG. 18 show the spring feeding device in part of the ultrasonic welding unit in the apparatus 1. The fabric is formed into a tube 44. The fabric may be folded along one or several surfaces to form the fabric tube 44. A portion 45 of the fabric tube may be formed to have a longitudinal welded seam.

As can be seen from FIG. 17 and FIG. 18, at least part of the at least one feeding member 60 may remain disposed within the tube 44 of fabric material for any position of the at least one feeding members 60. The pusher 70 may be disposed such that it at least partially extends into the tube 44 of fabric material for at least one position of the pusher 70.

Figure 19:
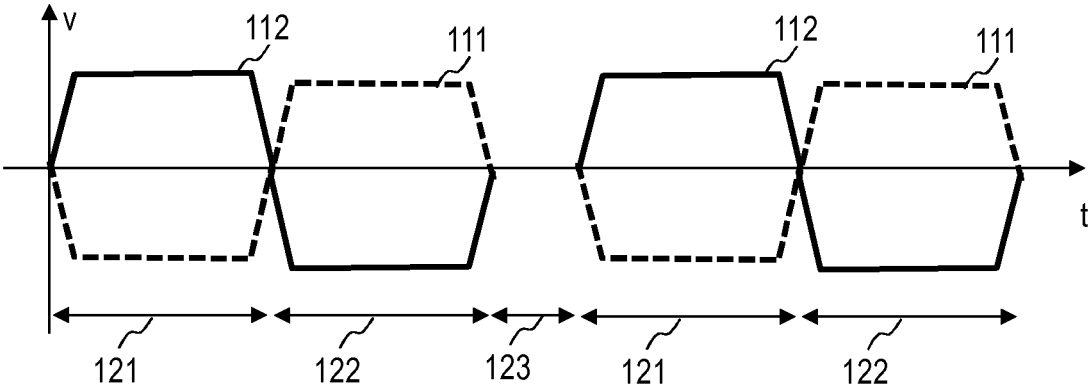
FIG. 19 is a diagram illustrating velocities of a feeding member and a pusher during operational phases of operating cycles.

FIG. 19 is a velocity diagram illustrating the operation of the spring feeding device according to an embodiment. FIG. 19 shows a velocity 111 of the at least one feeding member 60. FIG. 19 shows the velocity 112 of the pusher 70.

During a first phase 121 of an operating cycle, the at least one feeding member 60 is displaced in a first direction and the pusher 70 is displaced in an opposite second direction. The velocity 111 of the at least one feeding member 60 and the velocity 112 of the pusher 70 have opposite signs, but may have equal magnitudes.

In the first phase 121, the pusher 70 may push the spring along the length of the channel 68 delimited by the at least one feeding member 60.

In a second phase 122 of the operating cycle, the velocities of the at least one feeding member 60 and of the pusher 70 are respectively reversed compared to the first phase. The velocity 111 of the at least one feeding member 60 and the velocity 112 of the pusher 70 have opposite signs, but may have equal magnitudes. A sign of the velocity 111 of the at least one feeding member 60 is different in the first phase 121 and in the second phase 122. A sign of the velocity 112 of the pusher 70 is different in the first phase 121 and in the second phase 122.

In the second phase 122, the pusher 70 may be withdrawn further from the channel 68 while the at least one feeding members 60 continues to feed the spring retained the end portion 63 towards an ultrasonic welding unit.

In a third phase 123, the spring retained on the end portion 63 may be retrieved therefrom by the ultrasonic welding unit. Concurrently, a further spring may be inserted into the channel delimited by the at least one feeding member 60. The at least one feeding member 60 and the pusher 70 may be stationary in the third phase.

Figure 20:
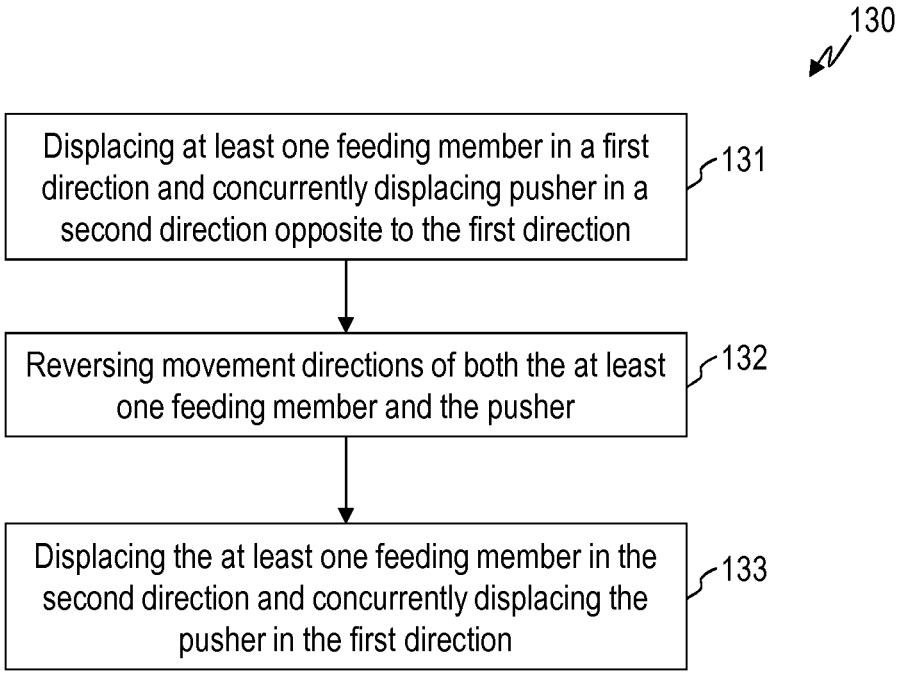
FIG. 20 is a flowchart of a method according to an embodiment.

FIG. 20 is a flow chart of a method 130 according to an embodiment. The method 130 may be performed by the spring feeding device 50 or the apparatus 1 according to an embodiment.

At 131, at least one feeding member 60 that delimits a channel 68 for receiving a spring is displaced in a first direction. Concurrently, a pusher 70 extending into the channel 68 is displaced in a second direction that is opposite to the first direction. Thereby, the spring may be displaced relative to the at least one feeding member 60 by a distance that is twice the displacement distance of either one of the pusher 70 are the at least one feeding member 60.

At 132, the movement directions of both the at least one feeding member and the pusher may be reversed. To this end, the control device 89 may control the power drive 81 such that the drive gear 82 is rotated with an opposite direction of rotation.

At 133, the at least one feeding member 60 that delimits a channel 68 is displaced in the second direction. Concurrently, the pusher 70 extending into the channel 68 is displaced in the first direction that is opposite to the second direction. Thereby, the spring may be advanced further towards an ultrasonic welding unit for forming a transverse seam while the pusher 70 may be withdrawn from the channel 68 such that a new spring may be inserted.

Steps 131-133 may be repeated in a cyclic manner. Further, the spring retained on the end portion 63 may be retrieved therefrom by an ultrasonic welding unit while a new spring is concurrently inserted into the channel 68.

While embodiments of the invention have been described with reference to the drawings, a wide variety of modifications may be implemented in other embodiments. For illustration, while one in the same power drive may be operated to drive both the pusher 70 and the at least one feeding member 60, separate drive units may be provided for the pusher 70 and the at least one feeding member 60. The drive mechanism may comprise a first drive unit that drives the at least one feeding member 60 and a second drive unit that drives the pusher 70 such that the at least one feeding member 16 and the pusher 70 are displaced in opposite directions, respectively in a reciprocating manner.

While embodiments have been described in which the channel in which the spring is received is delimited by a first feeding member 61 and a second feeding member 62 that are jointly displaced by the drive mechanism, the channel may also be delimited or formed within one single feeding member. The first feeding members 61 and the second feeding member 62 may be integrally formed.

While embodiments have been described in the context of an apparatus that also includes a spring former 21 and a spring setting device 30, the embodiments are not limited thereto. For illustration, the spring setting device may be provided as a separate apparatus which may be combined with a spring former apparatus and further downstream processing.

The spring feeding device, apparatus, and method according to embodiments of the invention may be used for manufacturing innerspring units for mattresses, sofas, armchairs, or other bedding or seating furniture, without being limited thereto.

The invention claimed is:

1. A spring feeding device configured to feed a spring for pocketing the spring, the spring feeding device comprising:
- a feeding member delimiting a channel,
- a pusher configured to push the spring along the channel delimited by the feeding member, and
- a drive mechanism configured to concurrently displace both the feeding member and the pusher such that the feeding member and the pusher move in opposite directions to reduce a travel path of the pusher compared to a device having a stationary channel thereby reducing a cycle time.

2. The spring feeding device of claim 1,
wherein the drive mechanism is configured
- to displace the feeding member in a first direction and to displace the pusher in a second direction opposite to the first direction during a first phase of an operating cycle and
- to displace the feeding member in the second direction and to displace the pusher in the first direction during a second phase of the operating cycle.

3. The spring feeding device of claim 2, wherein the drive mechanism is configured to concurrently displace the feeding member and the pusher in a translatory manner.

4. The spring feeding device of claim 1, wherein the drive mechanism comprises a drive belt to which both the feeding member and the pusher are coupled.

5. The spring feeding device of claim 4, wherein the drive belt has a first section and a second section extending parallel to the first section, wherein the feeding member is attached to the first section of the drive belt and the pusher is attached to the second section of the drive belt.

6. The spring feeding device of claim 4, wherein the drive mechanism comprises a power drive configured to alternatingly drive the drive belt in opposite directions.

7. The spring feeding device of claim 1, further comprising a control device configured to control the drive mechanism and the pocketing mechanism in a coordinated manner.

8. An apparatus for forming a string of pocket springs, comprising:

the spring feeding device of claim 1, and a pocketing mechanism configured to retrieve the spring from the spring feeding device and to enclose the spring in a pocket of fabric.

9. The apparatus of claim 8, wherein the pocketing mechanism comprises a bracket to which an ultrasonic sonotrode and/or an anvil are displaceably mounted, the bracket being pivotably mounted.

10. The apparatus of claim 9, wherein the bracket comprises a guide structure to guide displacement of the ultrasonic sonotrode and/or of the anvil relative to the bracket, wherein a pivot axis of the bracket extends transverse to a longitudinal axis of the guide structure.

11. The apparatus of claim 8, wherein the feeding member has an end portion which is dimensioned such that the spring projects from the end portion while the spring is retained on the end portion, wherein the ultrasonic sonotrode and/or the anvil is configured to be passed over the spring projecting from the end portion of the feeding member when the feeding member is at a discharge position to retrieve the spring.

* * * * *